United States Patent [19]

Marvaldi

[11] Patent Number: 4,742,963

[45] Date of Patent: May 10, 1988

[54] AEROSOL AIRBRUSH

[76] Inventor: Douglas A. Marvaldi, 180 N. Park Ave., Winter Park, Fla. 32789

[21] Appl. No.: 831,925

[22] Filed: Feb. 21, 1986

[51] Int. Cl.[4] ..... B05B 1/34

[52] U.S. Cl. ..... 239/337; 222/323; 222/472; 239/375; 239/590.3; 239/590.5

[58] Field of Search ..... 239/337, 569, 573, 590, 239/590.3, 525, 526, 532, 590.5, 375–378, 373, 372; 222/323, 465 R, 470, 472; 169/89

[56] References Cited

U.S. PATENT DOCUMENTS

| | | | |
|---|---|---|---|
| 264,317 | 9/1982 | McTighe et al. | 239/590.3 X |
| 1,892,750 | 1/1933 | Rothheim | 239/337 X |
| 1,985,455 | 12/1934 | Mosby | 239/337 |
| 2,136,940 | 11/1938 | Ehbrecht | 239/573 X |
| 2,167,866 | 8/1939 | Bennett | 239/337 X |
| 2,530,583 | 11/1950 | Nurkiewicz | 222/472 X |
| 2,736,919 | 3/1956 | Nurkiewicz | 169/89 X |
| 2,965,100 | 12/1960 | Bridges | 239/573 X |
| 3,138,331 | 6/1964 | Kutik | 239/337 |
| 3,265,248 | 8/1966 | Guest | 239/573 X |
| 3,957,208 | 5/1976 | Spivey | 239/372 |

FOREIGN PATENT DOCUMENTS

| | | | |
|---|---|---|---|
| 241263 | 8/1969 | U.S.S.R. | 239/590 |

*Primary Examiner*—Andres Kashnikow

*Attorney, Agent, or Firm*—William M. Hobby

[57] ABSTRACT

A portable aerosol airbrush type gun apparatus is used for applying liquid cosmetics. A pressurized container has a liquid cosmetic compound therein under pressure. An airbrush type nozzle is attached to the container and operatively connected thereinto and has a flow restrictor and a needle therein. A valve is mounted to the container adjacent the nozzle for releasing the pressurized liquid in the pressurized container into the nozzle responsive to the actuation of the valve. The valve has a hinged finger lever mounted for actuating the valve with an operator's finger. A handle is hinged to the container nozzle housing and has a first storage position adjacent the pressurized container and a second operating position for supporting the operator's hand so that facial makeup and cosmetics can be applied with an airbrush type nozzle in a pressurized storage aerosol container.

11 Claims, 1 Drawing Sheet

AEROSOL AIRBRUSH

BACKGROUND OF THE INVENTION

The present invention relates to the application of cosmetics and especially to an aerosol airbrush type nozzle for applying cosmetics to a person's skin.

In the past it has been common for people to apply cosmetics to the skin and face. Typically this involves applying a moisturizer to the face followed by applying a foundation which smoothes out the surface of the skin and skin color. This is typically followed by a lightner or consealer applied to the areas around the eye and then by the application of an eye shadow to provide color. The eye shadow may be followed by an eye liner to accentuate the area on the eyelid adjacent the eye. Mascara can then be applied to the eyelashes to accentuate the eyelashes. A blush or rouge can then be applied in a variety of colors and shades to add color to the face over the cheekbones. Once the rouge has been applied and smoothed out, powder is applied to the makeup on the face to set the makeup and to prevent it from smearing and falling off. Finally, a lip stick can be applied to the surface of the lips. Each of these makeup cosmetics comes in a variety of colors and shades so that different women having different complexions, different color hair and wearing different color clothes can use various colors shades and intensity to provide a more aesthetic looking face. In the past, it has been common to apply the various makeups with the hand, or from tubes, brushes or cosmetics pencils and this generally means applying a variety of different color cosmetics to obtain the desired intensity and color.

The present invention is directed toward the use of the various facial cosmetics using a very fine airbrush type nozzle. The airbrush has the advantage that it can be applied very precisely by a person using thinned out cosmetics in liquid form. Typically the shades can be varied by varying the application rate of the airbrush or by going over an area as many times as desired. This allows a more precise and exact control of the application of the facial cosmetics.

Airbrush technology has commonly been used for various types of painting, as well as in the field of photography for applying dyes and colors to photographic prints. Airbrushes are used to paint various commercial images where fine details and subtle variations of color intensity are desired. Basically, an air gun allows a very thinned out dye or paint to be applied through aspiration into an airbrush nozzle under a high pressure in a very fine aerosol application. An airbrush typically has a finger control which allows variation in the feed rate as well as precise turning on and off of the airbrush spray to allow very precise control. The present application of airbrush technology is being used to apply cosmetics. Inasmuch as most cosmetics are in a solid or heavy liquid state it requires first that the cosmetics be prepared in a dilute liquid suitable for use in an airbrush nozzle. The present application also allows the cosmetics to be packaged in a small pressurized aerosol container complete with a throw away or replaceable airbrush nozzle and control valve so that the cosmetics are portable and can be carried in a bag or maintained in a beauty parlor or home for application by an individual to their face or to another person's face. Only a small amount of training has been found necessary to learn to use the airbrush in the applying of cosmetics. Different nozzles or nozzle adjustments can be used for different types of cosmetics since some cosmetics require very fine lines and very accurate application while other require a broader spray pattern to obtain more coverage in a rapid manner. It is an aim of the present invention to provide an aerosol airbrush apparatus filled with a thinned liquid cosmetic for the application of facial and other cosmetics to the human skin. It will of course be recognized that other uses of the invention are to be considered within the spirit and scope of the invention.

SUMMARY OF THE INVENTION

The present invention relates to an aerosol sprayer apparatus for applying facial cosmetics and makeup and the like to a person's skin. A small pressurized container has a liquid facial cosmetic compound therein under pressure. An airbrush nozzle and valve combination are permanently or removably attached to the pressurized container. An airbrush nozzle is attached to the container and has a flow restrictor and a needle therein with the flow restrictor having a plurality of openings therethrough to create a venturi between the passage from one chamber to a second chamber in the nozzle. A valve is provided for releasing the pressurized liquid in the pressurized container responsive to the actuation thereof and is mounted to the container adjacent the nozzle and may form a part of the nozzle. The valve has a hinged finger lever mounted for actuation of the valve means with an operator's finger and may have a locking cap to hold the valve finger lever in a valve closed position when not in use. A handle is hinged to the valve and nozzle attached to the container and can be folded inside the container for storage and shipment and quickly shifted on a hinge to a second position and latched in place for supporting the user's hand during use of the aerosol sprayer.

BRIEF DESCRIPTION OF THE DRAWING

Other objects features and advantages of the present invention will be apparent from the written description and the drawings in which.

DESCRIPTION OF THE PREFERRED EMBODIMENT

Figure 1:
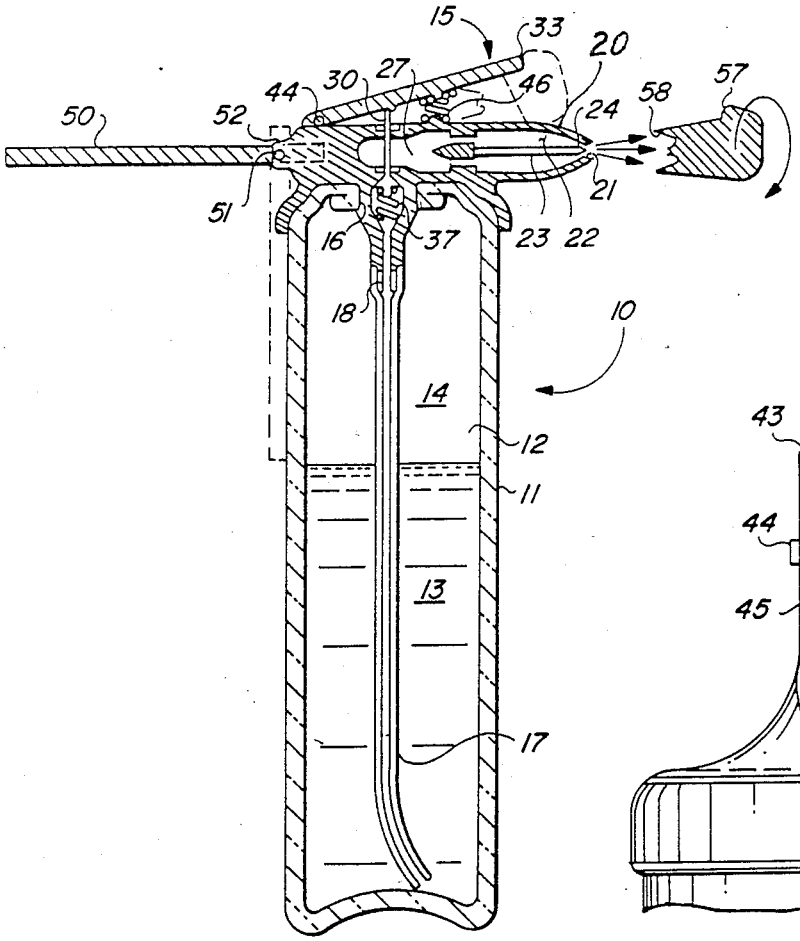
FIG. 1 is a sectional view of an aerosol sprayer in accordance with the invention.
Figure 2:
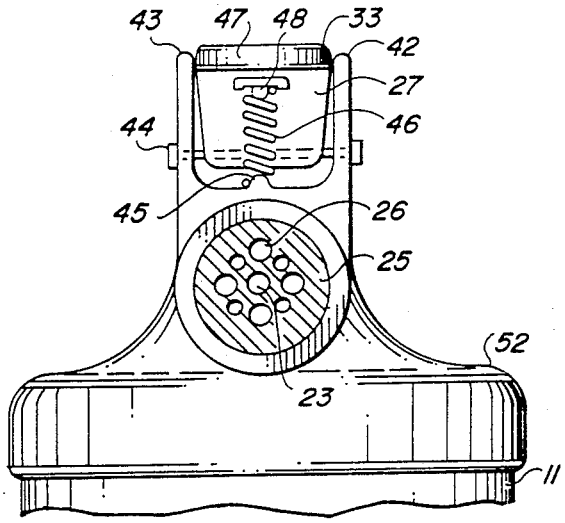
FIG. 2 is a sectional view taken showing the flow restrictor.
Figure 3:
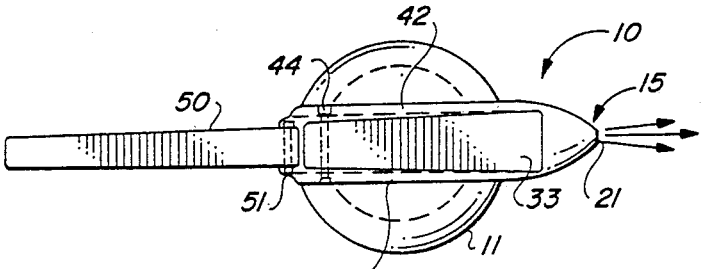
FIG. 3 is a top elevational of the aerosol brush of FIGS. 1 and 2.
Figure 4:
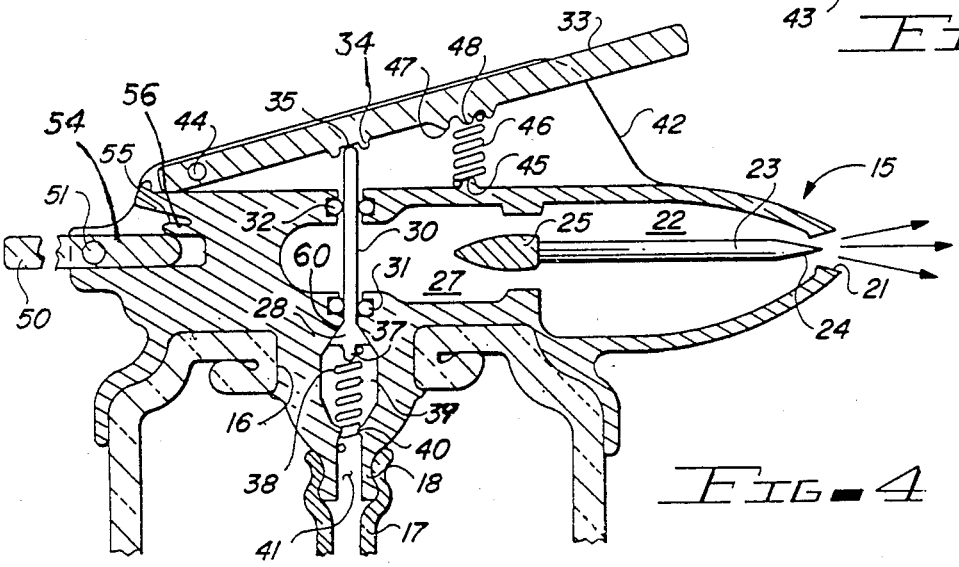
FIG. 4 is an enlarged sectional view of the airbrush valve and nozzle of FIGS. 1 through 3.

Referring to FIGS. 1 through 4 of the drawings, a cosmetic aerosol sprayer 10 has a pressurized container 11 having a chamber 12 partially filled with a liquid cosmetic 13 on the gas pressure in the upper container portion 14. The container has an type nozzle and valve apparatus 15 attached to the top portion thereof and extending through an opening 16 in the container casing 11 and having a discharge tube 17 attached to a connector portion 18 of the valve portion. The nozzle and valve portion 15 has a nozzle discharge portion 20 having a discharge aperture 21 connected to a discharge chamber 22 having a discharge needle 23 mounted therein having a needle point 24 positioned adjacent the aperture 21. The needle is supported by a needle holder and aerosol flow restrictor 25 which is more clearly seen in FIG. 2 and has a plurality of apertures 26 passing therethrough with the needle 23 supported in the middle thereof. The flow restrictor 25 creates a venturi between a nozzle chamber 27 and the discharge chamber 22. A valve element 28 is shaped in a cone-shape and has a valve rod 30 extending therefrom through a guide 31 through the chamber 27 through an O-ring seal 32 and is supported against a finger lever 33 having an annular ledge 34 forming a small dimple for the rounded end 35 of the rod 30. THe valve element 28 has a protruding portion 37 on the opposite end thereof from the shaft 30 for supporting one end of a biasing spring 38. The spring is positioned in the valve chamber 39 and is supported at its other end by an annular ledge 40 having the spring extended thereinto. An annular ledge 40 is adjacent passageway 41 passing through the tube coupling portion 18. A pair of finger lever guides 42 and 43 are located on either side of the finger lever 33 and the finger lever is pinned therebetween with a pin 44. The sides 42 and 43 have angled edges with the angled finger level 33 located therebetween. A small protrusion 45 on the top of the nozzle 20 is for supporting one end of a spring 46. The bottom of the finger lever 33 has an annular ledge 47 and another small bump 48 forming a support for the other end of the spring 46. Spring 46 biases the finger lever 33 in an upward position which is the closed position for the valve element 28. A flip handle 50 is pinned by pin 51 to the body portion 52 of the nozzle and valve portion 15. The handle 50 may be rotated on the pin 50 from a storage position adjacent the cylinder as shown in dashed lines in FIG. 1 to an open position as shown in FIGS. 1 and 3. In the open position, the handle tip portion 54 extending from the inside of the pin 51 is pushed against a tab portion 55 and against a handle spring lock 56 to lock the handle in the open position as shown in FIG. 1, 3 and 4. This snap lock allows the handle 50 to be rapidly shifted and snapped in place from a closed storage and shipping position to an open user position.

In operation the small aerosol canister 10 can be held in the hand and the handle 50 extended to the operative position as shown in FIG. 1 and the hand gripped under the handle 50 with the finger extending around on top of the finger lever 33. A locking cap 57 has a cleaning tip 58 thereon and can lock the finger lever 33 in a position as shown in FIG. 1 to prevent accidentally actuating the airbrush and then can be removed between the nozzle as shown in FIG. 1. Depending upon the cosmetic solution it may require that a canister 10 be shakened to mix up the cosmetic. The aerosol canister 10 can then be actuated by pushing the finger lever 33 which in turn pushed the valve shaft 30 through the O-ring seals 32 and guide 31 to push the valve element 28 away from the valve seat 60 against the spring 37. This allows the liquid cosmetic to pass through the tube 17 through the passageway 41 through the valve chamber 38 into the nozzle chamber 27 where the liquid is first expanded. The liquid cosmetic is then passed through the aerosol flow restrictor which increases the speed of flow by virtue of the venturi formed by the flow restrictor and then expands the liquid again into the discharge chamber 22. The liquid cosmetic is then forced through the discharge aperture 21 around the point 24 of the needle thereby producing a fine airbrush spray which may have a pattern depending upon the cosmetic being sprayed with a finer spray pattern for some cosmetics and a broader spray for others.

The use of an aerosol applicator allows the application of light cosmetics and then a buildup of color intensity since the more color added in an aerosol spray the more intense the color. The spray buildup in any particular point on a person's skin is obtained. This allows a very accurate and rapid application of cosmetics to a person's skin and in many cases can be applied by the person themselves with the use of a mirror but in some cases would have to be applied by another person but it will of course be clear that several cosmetics and even a foundation base can be applied through separate canisters but that other cosmetics can be applied in a more conventional manner in combination with the present applications. A separate canister for each of those cosmetics used is supplied filled with the predetermined liquid cosmetic so that the several canisters will allow the rapid application of the cosmetics. It should however be clear that the present invention is not to be considered limited to the forms shown which are be considered illustrative rather than restrictive.

I claim:

1. An aerosol sprayer apparatus for applying liquid cosmetics, and the like, comprising in combination:

a pressurized container having a liquid makeup compound therein under pressure;

a nozzle having a housing and attached to the container and having a flow restrictor and a needle supported on the flow restrictor, the flow restrictor having a plurality of openings therethrough;

valve means for releasing the pressurized liquid in the pressurized container responsive to actuation thereof and being mounted to said container adjacent said nozzle, said valve means having a hinged finger lever mounted for actuating the valve means, said valve means hinged finger lever being hinged to said nozzle housing between a pair of finger lever sides formed in said housing; and handle means hinged to the nozzle housing and having a first storage position and a second operating position said handle means being pinned to said nozzle housing and swingable from the first position adjacent the pressurized container to a second position and having a latch means for holding said handle in the second position, whereby an aerosol cosmetic applicator uses a pressurized storage container.

2. An aerosol sprayer apparatus in accordance with claim 1 in which the nozzle and valve means are integrated into a single housing attached to the pressurized container.

3. An aerosol sprayer apparatus in accordance with claim 2 in which said latch means is a tab latch in which one end of the handle is directed against a spring tab.

4. An aerosol sprayer apparatus in accordance with claim 2 in which said finger lever has a dimple formed therein for pushing against a valve rod of said valve means, said valve rod being connected to a valve element held in a valve seat which is opened by sliding said valve rod responsive to pushing said finger lever.

5. An aerosol sprayer apparatus in accordance with claim 4 in which said valve element is located in a valve chamber and has a spring therein for biasing said valve element in the valve seat.

6. An aerosol sprayer apparatus in accordance with claim 5 in which said valve element spring is supported on a protursion on one side of said valve element and held in an annular ledge in said valve chamber and said valve element chamber has a passageway therefrom through a tube coupling.

7. An aerosol sprayer apparatus in accordance with claim 5 in which a hollow discharge tube is attached to said valve tube coupling and extends into said pressurized container.

8. An aerosol sprayer apparatus in accordance with claim 7 in which said valve means has an O-ring seal positioned in the nozzle housing.

9. An aerosol sprayer apparatus in accordance with claim 8 in which said nozzle flow restrictor has a plurality of apertures therethrough and said needle supported therein and said nozzle flow restrictor being attached to the nozzle and valve means housing.

10. An aerosol sprayer apparatus in accrodance with claim 9 in which said finger lever has an annular groove formed therein for supporting one side of a spring and said nozzle housing has a small stud formed thereon for supporting the other end of the spring.

11. An aerosol sprayer apparatus in accordance with claim 10 including a finger lever locking cap for locking said finger lever in a valve closed position.

* * * * *